US007491125B2

(12) United States Patent
Mathis et al.

(10) Patent No.: US 7,491,125 B2
(45) Date of Patent: Feb. 17, 2009

(54) CHIP TRAY LOADING DEVICE AND PROCESS

(75) Inventors: Gwen D. Mathis, Las Vegas, NV (US); Ewoud A. Budding, Las Vegas, NV (US)

(73) Assignee: JCM American Corporation, Las Vegas, NV (US)

( * ) Notice: Subject to any disclaimer, the term of this patent is extended or adjusted under 35 U.S.C. 154(b) by 309 days.

(21) Appl. No.: 11/388,706

(22) Filed: Mar. 24, 2006

(65) Prior Publication Data

US 2007/0060313 A1 Mar. 15, 2007

Related U.S. Application Data

(63) Continuation-in-part of application No. 11/202,304, filed on Aug. 11, 2005.

(51) Int. Cl.
*A63B 71/00* (2006.01)

(52) U.S. Cl. ..... 463/47

(58) Field of Classification Search ..... 463/1, 463/16–20, 25, 29, 47
See application file for complete search history.

(56) References Cited

U.S. PATENT DOCUMENTS 4,614,342 A 9/1986 Takashima
4,746,110 A 5/1988 Chiba
4,755,941 A 7/1988 Bacchi
4,813,675 A 3/1989 Greenwood
5,078,405 A 1/1992 Jones et al.
5,112,060 A 5/1992 Jones
5,113,990 A 5/1992 Gabrius et al.
5,290,033 A 3/1994 Bittner et al.
5,301,618 A 4/1994 Abendschein et al.
5,393,067 A 2/1995 Paulsen et al.
5,559,312 A 9/1996 Lucero
5,588,650 A 12/1996 Eman et al.
5,655,961 A 8/1997 Acres et al.
5,735,742 A 4/1998 French
5,737,418 A 4/1998 Saffari et al.
5,775,993 A 7/1998 Fentz et al.
5,779,546 A 7/1998 Meissner et al.
5,809,482 A 9/1998 Strisower
5,823,875 A 10/1998 Tarantino (Continued)

OTHER PUBLICATIONS

"Chip Washer", www.tcsjohnhuxley.com, 2

(Continued)

*Primary Examiner*—Scott E Jones
(74) *Attorney, Agent, or Firm*—James D. Erickson

(57) ABSTRACT

A chip dispensing kiosk including a vault for holding casino chips, a dispensing assembly for dispensing selected numbers of casino chips and security and input systems to allow a pit manager to access the kiosk and have the kiosk dispense selected numbers of chips. These chips may be dispensed individually, in stacks or automatically loaded into a table chip tray back module. The kiosk is interactive with the casino's accounting system so as to report the dispensing of casino chips or receipt of casino chips. One preferred embodiment consists of a casino back room, cage, or Pit area chip tray management device that can be utilized by casino personnel to physically accept and count dumped gaming chips, communicate information with an ICT Intelligent Chip Tray Module, and automatically reload the chip tray per computer controlled specifications for any given table ID or chip loading requirement.

17 Claims, 5 Drawing Sheets

U.S. PATENT DOCUMENTS

| | | | | |
|---|---|---|---|---|
| 5,836,818 | A | 11/1998 | Jones et al. | |
| 5,907,141 | A | 5/1999 | Deaville et al. | |
| 5,941,769 | A | 8/1999 | Order | |
| 5,957,776 | A | 9/1999 | Hoehne | |
| 6,048,269 | A | 4/2000 | Burns et al. | |
| 6,264,556 | B1 | 7/2001 | Izawa et al. | |
| 6,283,856 | B1 | 9/2001 | Mothwurf | |
| 6,296,101 | B1 | 10/2001 | Hasegawa et al. | |
| 6,506,115 | B1 | 1/2003 | Mothwurf | |
| 6,530,836 | B2 | 3/2003 | Soltys et al. | |
| 6,629,889 | B2 * | 10/2003 | Mothwurf | 463/25 |
| 6,733,388 | B2 | 5/2004 | Mothwurf | |
| 6,745,887 | B2 | 6/2004 | Heidel et al. | |
| 2004/0030622 | A1 | 2/2004 | Ramos et al. | |
| 2004/0222061 | A1 | 11/2004 | Heidel et al. | |
| 2005/0040006 | A1 | 2/2005 | Kodela et al. | |
| 2005/0121286 | A1 | 6/2005 | Iannello et al. | |
| 2005/0126880 | A1 | 6/2005 | Iannello et al. | |
| 2005/0126881 | A1 | 6/2005 | Iannello et al. | |

OTHER PUBLICATIONS

"Chipper Champ 2", www.tcsjohnhuxley.com, 3.
"Chipper Champ Plus", www.tcsjohnhuxley.com, 2.
"The Easy Chipper", www.Shufflemaster.com, 3.

* cited by examiner

CHIP TRAY LOADING DEVICE AND PROCESS

This application is a Continuation In Part of U.S. application Ser. No. 11/202,304, filed on Aug. 11, 2005, entitled Inventory Manager—Chip Kiosk.

BACKGROUND OF THE INVENTION

1. Field of the Invention

The present invention is generally directed to the field of casino management and in particular to a device and process whereby casino chips can be automatically sorted and loaded into trays to provide a supply of casino chip trays to gaming stations within a select area of the casino. In one embodiment, the invention contemplates a sorting, stacking and loading device that loads a chip tray to exact specifications corresponding to various programmable or selectable chip denomination configurations.

2. General Background and State of the Art

Modern casinos have evolved to incorporate hundreds or thousands of slot machines or other types of coin or ticket operated gaming machines. However, gaming tables where players can play blackjack, poker games, roulette or craps remain as a mainstay of the casino design. Generally, the slot machines are placed around one or more gaming table pit areas. A single pit area may include such gaming tables such as blackjack or poker tables, roulette tables and crap tables. The pit areas are generally positioned in a central portion of an open area within the casino. Each pit area is overseen by a pit manager, responsible for a significant number of oversight functions including security, detecting improper play, and table money and chip management.

Each gaming table includes a chip tray for continually organizing and storing the bank of chips used for play on that table during its operation. The dealer, croupier, or operator collects the chips from lost player bets and places them in the tray and in turn pays chips for winning bets from this tray to the winning player. Depending on the number of players and the magnitude of their game wagers, the value of the chip bank stacked in the table chip tray at any given time will significantly change on a continuous basis during a shift or operational period of the table game. In large modern casinos ICT or Intelligent Chip Tracking systems provide the ability to monitor this chip bank value or level on a continuous basis on each table by various electronic means. However, a precise accounting of the physical chips contained in the tray at given intervals such as at shift start and end may be required to independently verify such chip tray inventory starting and ending values. And in smaller less automated casinos it becomes vital to meet regulatory auditing requirements of table game revenues by performing periodic physical counts of the chip tray bank inventory. Such independent physical verifications can be time consuming and labor intensive.

Additionally most US casinos do not return the table chip trays to a standard chip tray bank value and/or chip denomination configuration upon opening or starting such a table's period of operation due to the time and labor required for reloading the chip tray to such a standard. The chip denomination configuration is comprised of such components as the number of different chip denominations in the tray, the values of the chip denominations in the tray, the number of chips of each different denomination in the tray, and the channel locations and quantities of each chip denomination in the tray. Such standards would of course vary by type of table game, and minimum bet denomination set for play in a specific table game.

Casinos also include an accounting cage and/or a back room area, which is discreetly and securely located away from the center of activity within a casino. In many casino environments when open a gaming table, it is necessary for the casino to arrange to have casino chips delivered from a caged vault area across the casino floor to the gaming table located in a particular pit area or grouping of gaming tables. Restocking of a gaming table chip tray during the course of play may be necessary if patrons have several wins and additional chips are necessary. Restocking a gaming table during the course of play can be distracting to the players and cause the casinos to lose revenue if an impatient player must wait for additional casino chips to be delivered to the gaming table.

Accordingly, it would be beneficial to have the ability to restock a gaming table with casino chips from a position located proximate to the pit area. However, since the casino chips can be utilized as money within the casino, and have values from one dollar to several thousand dollars, precise accounting for the casino chips within the accounting system is mandatory at all times. Whether these table chip trays are counted and reloaded in the pit area or in a more secure gage or back room area, it would be desirable to automate the physical counting, sorting and reloading process to provide accuracy, controllability, flexibility, simplicity and speed.

Although devices currently exist with the capacity to count and sort gaming table chips into columns of similar colors or denomination values. These existing devices do not automatically load a gaming table chip tray with a specified bank value and/or chip denomination configuration as previously described.

SUMMARY OF THE INVENTION

One embodiment of the present invention is directed to a chip dispensing kiosk including a vault for holding the casino chips, a dispensing assembly for dispensing selected numbers of casino chips and security and input systems to allow a pit manager to access the kiosk and have the kiosk dispense selected numbers of chips directly to the pit manager or his designee at a work station. These chips can be dispensed in a number of optional formats including but not limited to stacks of chips, chips loaded into a bulk chip tray carrier, or chips loaded into a table chip tray bank. The kiosk is interactive with the casino's accounting system so as to report the dispensing of casino chips or receipt of casino chips. Security features built into the kiosk, as well as in the casino pit area, monitor the dispensing of the casino chips and delivery of the casino chips to the appropriate gaming table. By the present invention, the kiosk can be stocked with a substantial number of chips as necessary to provide the tables within a pit area with sufficient chips to satisfy the anticipated requirements of a shift or daily operation, and thereby reduce or eliminate the number of times when casino chips must be taken from a caged accounting system across the floor of the casino to the gaming tables.

Optionally the kiosk can also provide secure storage and dispensing of various event transaction documents that may be required to maintain compliance with existing or future regulations for tracking chip removal and deposit events at the kiosk. Such documents can provide not only an accounting trail for the movement of all chips in and out of the chip kiosk, but also their movement from and to the various gaming tables and or players in the pit area managed. These event transaction documents can be in the preferred form of machine printable and readable tickets or cards or as a backup in the form of hand written forms that are issued by the respective pit personnel and inserted into the kiosk for secure storage until they can be transported along with the other contents of the kiosk vault to a caged accounting room for verification and tabulation.

As a further anticipated option to the event management of the chip kiosk system disclosed herein, various forms of secure electrical or wireless signals can be used for requesting, approving, and/or confirming such chip transfers between the chip kiosk and the tables and/or players in the pit area serviced by the system. These event signals can easily be encrypted by various means known in the art and can originate either from proprietary codes keyed into keypads at the kiosk, pit workstation, and/or gaming tables by pit personnel or through secure transmissions from wireless portable personal data devices issued to authorized pit personnel. These signals are then easily monitored and tracked by one or more of the processors linked to the kiosk system components. Security of such event signals can be insured through any number of means known to those skilled in the art including but not limited to encryption, personal access codes, biometric scanning devices, proprietary communication protocols, unique RFID tags, and/or personal unique integrated circuit chip cards.

Another embodiment consists of a smaller and more simplified table-top or free standing chip tray loading device. This device is its simplest form may be mainly comprised of a chip drop/acceptance slot, means for identifying chip denomination, means for separating or sorting chips into respective groups of chips of same denomination or type, control system for performing calculations on chip denomination data and controlling the sorting and dispensing means of said chip tray loading device, and dispensing means for loading a removable gaming table chip tray to a selected chip tray bank value and chip denomination configuration.

DETAILED DESCRIPTION OF THE PREFERRED EMBODIMENTS

Figure 1:
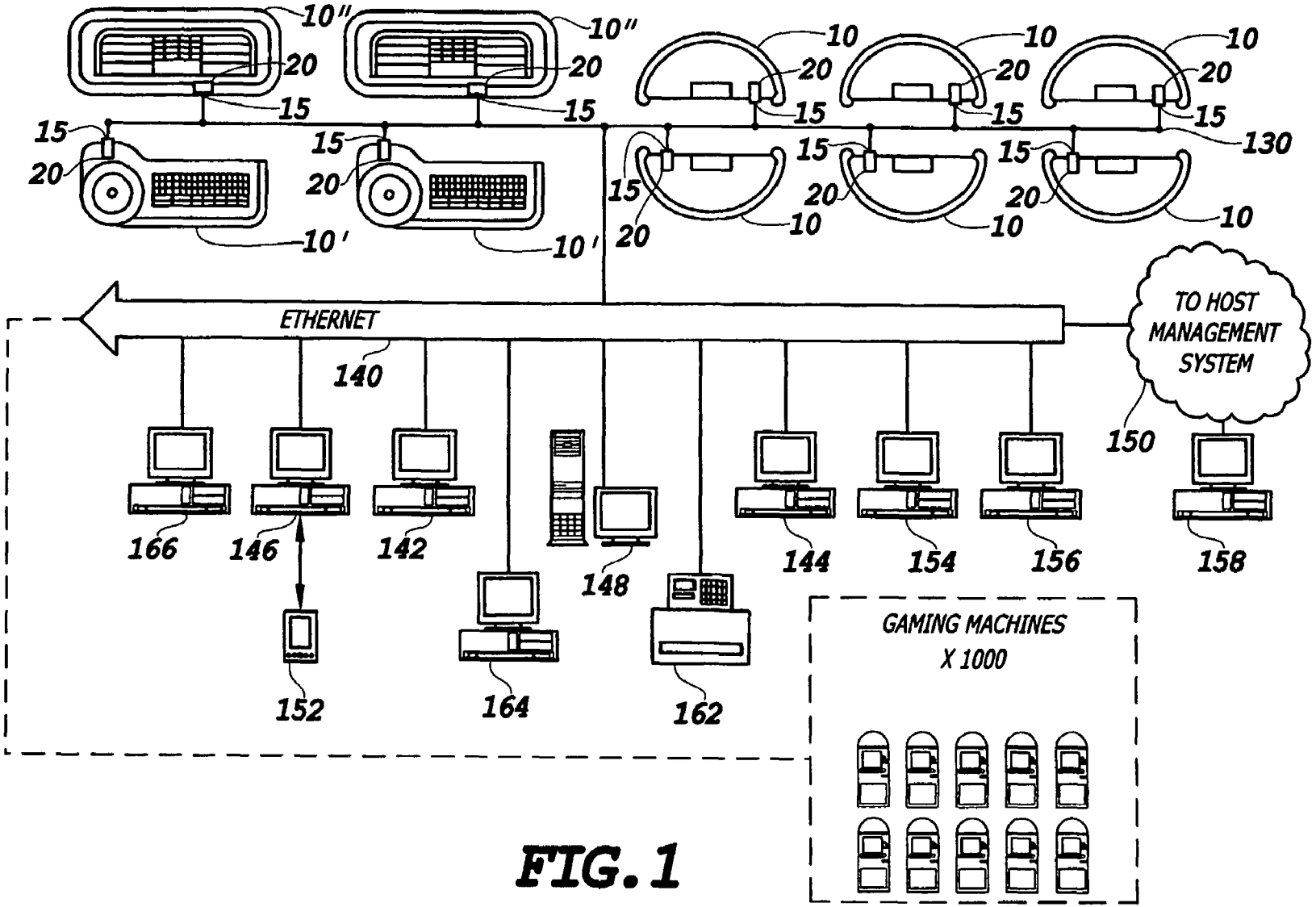
FIG. 1 schematically depicts a typical pit area including a number of gaming tables as well as a distributed interconnected computer system including a hookup to a kiosk and pit work station.

FIG. 1, schematically depicts multiple gaming tables 10 each having bill acceptors 20 that are interconnected over a low-level network 130 to an Ethernet 140. These bill acceptors 20 can function as a chip gaming station processor or one or more tables may optionally have separate gaming station processors 15 interconnected with the bill acceptors 20 and the low-level network 130. FIG. 1 shows six card tables 10, two roulette tables 10' and two craps tables 10", representing a discrete pit area. It is to be understood that any type and number of chip gaming station processors 15 or tables 10 can be arranged in a pit area and that multiple groups of tables, each group being overseen by a Pit Manager, may be positioned within the casino. A more detailed description of the components of the systems depicted in FIG. 1 can be found in U.S. patent application Ser. Nos. 10/941,316, and 10/081,756 now U.S. Pat. No. 6,745,887 herein incorporated by reference.

The Ethernet 140 may also be connected to a gathering processor 142, which is responsible for gathering game-related information from each bill acceptor 20 at each game table 10 via network 130, and for transferring the game-related information to other computers on the Ethernet 140. Gathering Processor 142 relays this information to a router 144. Router 144 is the router for the Ethernet 140. The data received by the router 144 is relayed to the pit workstation 146 and to the structured query language Database Server 148, the Database Server 148 houses the system database for the casino and, in most cases, the majority of the system applications themselves. In addition to the validators of the various gaming tables, the Database Server 148 may also be interconnected via the Ethernet 140 to a plurality (n) of gaming machines within the casino, or within other casinos, and to the note validators therein. This interconnectivity allows the Database Server 148 to control the printing, verification, and cancellation of tickets at the gaming machines as well as at the gaming tables.

In the foregoing system, the pit workstation 146 is the primary interface between pit personnel (the Pit Manager or designee) responsible for a group of gaming tables 10 as shown in FIG. 1, and the interface with the Database Server 148 and a host management system 150. The pit personnel can view individual game or table information at the pit workstation 146 for a given game table 10 and execute system functions on the pit workstation 146 including printing of certain types of tickets and reporting to the Database Server 148. Optionally, the pit workstation 146 may be configured to couple with handheld or portable computer devices 152, such as personal data assistants ("PDA"), to download information directly to the PDA for pit personnel and/or the Pit Manager, so that the Pit Manager does not need to stay by the pit workstation 146 to receive updates. Such an interface between a handheld device 152 and the pit workstation 146 could also be used to initiate, receive, approve, and/or confirm signals associated with chip transactions within a given pit area between various pit stations and the kiosk as carried out by other authorized pit personnel.

The system of FIG. 1 also depicts a number of additional computers or workstations connected via Ethernet 140. The console computer 154 ensures that all functions and processes are conducted in accordance with the rules and regulations established by the users and administrators having authority to access the system. The player tracking gateway computer 156 serves as an interface between the host management system 150 and the marketing database of a casino management system. The host management system 150 may have an administrator terminal 158. The player-tracking gateway computer 156 enables the merge of slot and table tracking into a common database. Computers operating as the gathering processor 142, router 144, console computer 154, player tracking gateway computer 156 and the host management system 150 with its administrator terminal 158 may all be individual applications found within one computer such as the Database Server 148.

The Ethernet 140 also provides the capacity for interconnecting the various computers to one or more chip dispensing kiosks 162 preferably located proximate to the pit area between gaming tables 10 or possibly incorporated into the pit workstation 146. Further, the Ethernet 140 allows interconnection of the chip dispensing kiosk 162 to the count room computer 166, located in the count room, so that all information available from the bill acceptors 20 located at each gaming table 10 as well as all information from the chip dispensing kiosk 162 is communicated to the count room computer 166.

The network topology of FIG. 1 may vary considerably from casino to casino and from application to application. FIG. 1 is simply an illustration of an approach and is not meant to limit the teachings of the present invention as contained herein. The computer systems may be personal computer-based systems having conventional input such as keyboards, mouse controls, touch screens, bar code/ticket readers and printers. The teachings of the system of the present invention are independent of the specific nature and type of computer system and input devices as casinos generally have these computer components in place. The existing computer systems can be augmented to accommodate the advantages made available by implementation of the bill acceptors 20 at the gaming tables 10 with the addition of software modules and the appropriate hardware connections.

As in the case of the networked computer system, the specific implementation of the necessary software programs to integrate the present invention into a casino management system will need to be compatible with the existing or to be implemented software in the Database Server 148. The following discussion of the various functions to be implemented into the software module are therefore described in a manner to be exemplary in nature, it being understood that the concepts herein can be developed by those skilled with the various software operating systems utilized by casinos.

The provision at each of the gaming tables 10 of the bill acceptors 20 interconnected via the Ethernet 140 to the supervisory stations allows for a number of transactions or "Events" to be accounted for at each gaming table 10. Transaction events include, by way of example only, coded tickets or signals representing the following types of transactions:

An Opener Event is, for example, the receipt of a note, cash or ticket for example a ticket printed by a slot machine, from a player that is exchanged for tokens or chips when a player wishes to join or continue playing on the gaming table 10.

A Fill Event occurs when a gaming table 10 requires additional casino chips from a cashier station or chip dispensing kiosk 162. A Fill Event may be requested whenever a gaming table 10 is first opened as the table will need to be provided with casino chips. A Fill Event may also be required when there is a substantial buy-in by a player or when a player wins a substantial amount and the table requires additional casino chips. A Fill Event ticket is either printed at the gaming table 10 by the bill acceptor 20 or at the pit workstation 146. Once the Fill Event ticket is printed, it is taken to the chip dispensing kiosk 162, inserted into the validator therein and, after verification, security checks and communication with the Database Server 148, the chip dispensing kiosk 162 dispenses the necessary casino chips. The casino chips, preferably with the Fill Event ticket, or a duplicate thereof, are then taken to the gaming table 10 and the Fill Event ticket is inserted into and read by the bill validator 20, which reports the Fill Event to the Data Base Server 148.

A Credit Event is a transaction in which a dealer at a gaming table returns some, but not all, chips to a cashier or chip kiosk in the casino in exchange for a credit ticket. The cashier or chip dispensing kiosk 162 prints a credit ticket that is returned to the dealer and the credit ticket is inserted into the bill acceptor 20 so that the system including the Database Server 148 and pit workstation 146 are advised that chips have been taken from a table and returned to a cashier or chip dispensing kiosk 162.

A Closer Event occurs when a gaming table is taken out of service and all casino chips are removed from the gaming table and returned to the cashier station or alternatively to the chip dispensing kiosk 162. The chips are counted and the Pit Manager or the dealer generates a closer ticket either at the pit workstation 146 or at the gaming table 10 on the bill acceptor 20. The closer ticket is inserted into the bill acceptor 20 where it is recorded. A copy may also be delivered with the casino chips to the cashier station or to the chip dispensing kiosk 162. Chips deposited into the chip dispensing kiosk 162 may be validated and counted to cross check against the values specified on the closer ticket when the cash boxes from the bill acceptors 20 are taken to the counting room, all of the transactions from the Opening Event to the Closing Event are tabulated and compared to the notes in the cash box including the transaction event tickets.

It should be noted that while the examples above describe the specific use of printed event tickets for initiating, approval, and/or confirmation of the chip transaction or event, one or more of these functions could optionally be performed and transmitted between system components trough the use of an electronic signal followed up by a printed audit record and/or an audit summary transmitted through the Ethernet 140 to the host management system 150. This system can operate at any level of automation and accountability allowed by law or casino management policy.

The chip dispensing kiosk 162 can be optionally process an event request through direct input to the attached touch pad 226 (shown in FIG. 2) by authorized pit personnel providing the required secure identification code or information. Such authorization may be validated by means including but not limited to providing a unique personal ID badge or card, authorization code number, and/or other biometric identification. The chip kiosk would then dispense or receive the chips and document the transaction by printing or transmitting audit information for system accounting purposes to the Database Server 148. Such an event transaction could for example have been initiated on the Pit Manager' own initiative or by any other method of event request signal transmission from a table or player including but not limited to verbal, hand written, or electronic. In the case of a hand written request form the record may be deposited into an optional document drop slot 232 in the chip dispensing kiosk 162 for secure storage in an optional document compartment 281 in the chip vault 240 (see FIG. 3). A similar optional secure document compartment may be located in the bill acceptor assembly (not shown).

The chip dispensing kiosk 162 can preferably receive, read and respond to printed event tickets as discussed above where the tickets are received through the ticket/bill acceptor slot 222 in the chip dispenser kiosk 162 and stored in ticket/bill compartment 251 in the chip vault 240. When the chip vault 240 is returned to the caged counting area of the casino both the optional document compartment 281 and the ticket/bill compartment 251 are emptied so that the paper documents and tickets removed there from can serve as tracking documentation. Then providing redundant monitoring information through the network to those with access to the system and the Database Server 148.

As a further option an event signal could be received by the chip dispensing kiosk 162 electronically either by means of its network connection from those authorized to access the Ethernet 140 for generating such event requests or additionally through wireless communication by means of a secure transmission from an authorized handheld computer device 152. To ensure security for such an event signal acceptance various means of encryption could be utilized in conjunction with the device's communication protocol as well as other possible requirements for authorization code submission.

Again the audit trail can consist of printed transaction audit reports and/or electronic audit reports directly to the Database Server 148.

It should be noted that when a pit area has no chip dispenser kiosk 162 or if the chip dispenser kiosk 162 does not include the optional chip tray loading feature the gaming chips from a fill or closer event could alternatively be conveyed to or from a separate chip tray loading device 362 (FIG. 5) having the capacity to physically count and automatically reload the table tray to the same or new chip denomination configuration. Such a device could be located in the pit area, in a local cashier's cage or a back room area. Typically this device would not hold quantities of additional chips as large as the chip dispenser kiosk 162 nor would it provide the large storage capacity or security available with a chip dispenser kiosk 162. However, the chip tray loading device 362 would provide means for quickly auditing or restocking a table chip tray bank or quickly supplying a fresh replacement table chip tray.

The bill acceptors 20 which may act as the chip gaming station processor in the absence of a separate chip gaming station processor 15 can be programmed so that they will accept a number of different types of notes besides currency. The bill acceptors 20 may also preferably include a printer, which allows the bill acceptor to print out various types of tickets including, for example, a cash-out ticket that can be issued to a player, as well as opener tickets, credit tickets and closer tickets. These features, together with the interconnection to the casino server system allow for a number of enhancements in the control of the table gaming events.

Figure 2:
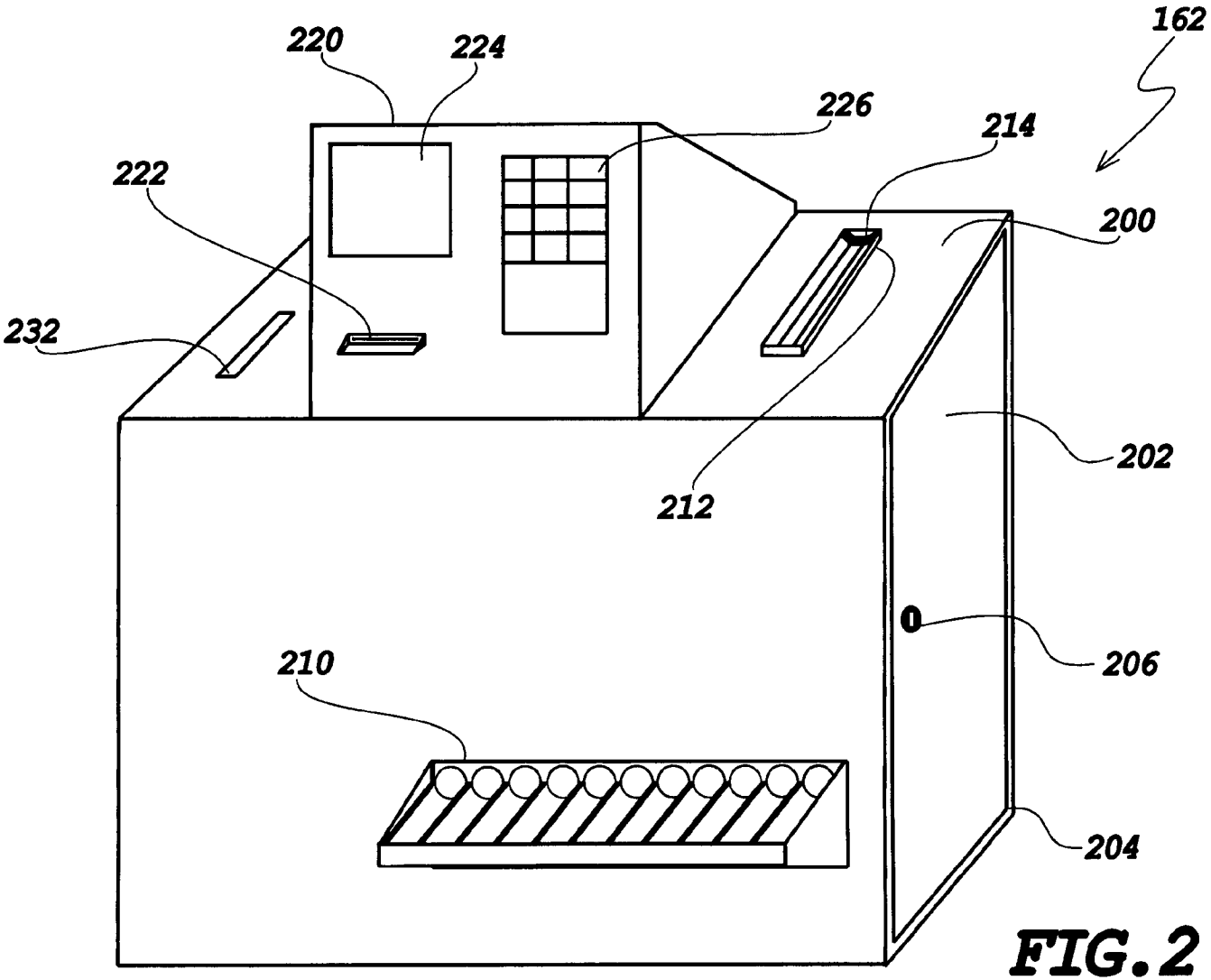
FIG. 2 is a perspective view of a casino chip kiosk according to the present invention.

FIG. 2 depicts a perspective view of a chip dispensing kiosk 162 of FIG. 1. The chip dispensing kiosk 162 includes a housing 200 having a door 202 secured via a hinge 204 and a lock 206 to the housing 200. On the front of the housing 200 is a chip dispensing tray 210 to which casino chips can be dispensed in a manner such that they remain organized in rows or stacks. On the top of the housing 200 the chip dispensing kiosk 162 can include a chip deposit bezel 212 leading to a chip drop slot 214. Casino chips placed in the chip deposit bezel 212 drop through the chip drop slot 214 and are counted within the chip dispensing kiosk 162 and then sorted and stacked within the chip dispensing kiosk 162. Also located on the top of the housing 200 is a kiosk control assembly 220. The kiosk control assembly 220 includes a ticket/bill acceptor slot 222, a screen display 224 and a touch pad or touch screen 226. The kiosk control assembly 220 includes the electronics that control the operation of the chip dispensing kiosk 162. Preferably, the control assembly 220 is electrically interconnected to the distributed network system so that the information available to and from the distributed network system can be utilized by the chip dispensing kiosk 162. This electrical interconnection can be either by wire/cable or alternatively by means of a wireless link to the router 144 connected to the Ethernet 140.

Figure 3:
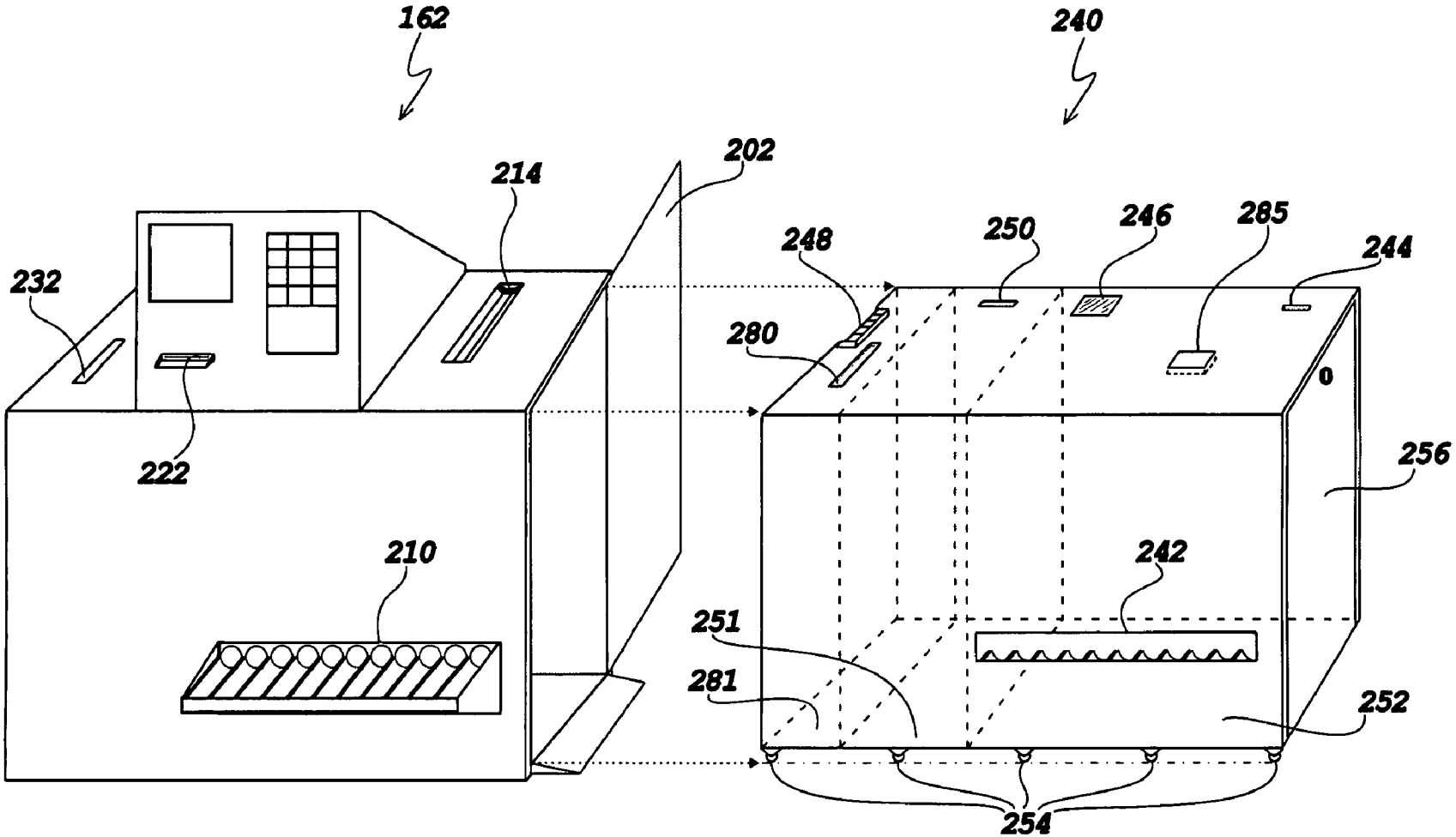
FIG. 3 is a perspective view of the casino chip kiosk of FIG. 2 with the vault exposed.

FIG. 3 depicts a perspective view of the chip dispensing kiosk 162 having a chip vault 240 removed from the inside thereof. The chip vault 240 includes a chip dispensing chute 242 on the front thereof that mates with and provides chips to the chip dispensing tray 210 of the chip dispensing kiosk 162. The chip vault 240 also includes a chip receiving drop slot 244, which is configured to be below the chip drop slot 214 and chip validator on the top of the chip dispensing kiosk 162. The chip vault 240 also includes either or both of an optical coupler 246 or an electronic coupling contacts 248 to provide information and data exchange capabilities as well as power to the chip vault 240 from the chip dispensing kiosk 162. In addition, the chip vault 240 preferably includes a ticket/bill intake slot 250 through which tickets or cash received by the ticket/bill acceptor slot 222 are passed for storage within the ticket/bill compartment 251 of the chip vault 240. Optionally the chip vault 240 also includes a document intake slot 280 juxtaposed to the document drop slot 232 of the chip dispensing kiosk 162 through which documents pass to the secure document compartment 281.

Generally, the chip vault 240 includes a housing 252 mounted on a plurality of wheels 254 to allow the chip vault 240 to be moved about the floor of a casino or mounted on a pallet for moving within a casino and configured to be easily inserted into and aligned with the inside of the chip dispensing kiosk 162. The one side 256 of the chip vault 240 may be hingedly attached so as to allow access to the inside of the chip vault 240 to allow for restocking of the chips contained therein in the count room. Of course any side or even the top of the chip vault could be hinged or provide a door opening for this purpose. However, once the chip vault 240 leaves the count room, it is secured and cannot be opened and there is no access to the contents until it is placed within the chip dispensing kiosk 162 and establishes data communication with the chip dispensing kiosk 162 to report that it has been securely inserted into the chip dispensing kiosk 162 and that the door 202 of the chip dispensing kiosk 162 has been closed and secured. The chips secured within the chip vault 240 cannot be removed other than via dispensing from within the chip dispensing kiosk 162 wherein each dispensing is tracked and monitored and only permitted upon proper security and authorization.

Optionally the chip vault can include a tracking device 285 to allow the casino to physically track the location of the chip vault at all times as it is moved through the casino between the chip dispensing kiosk and the caged counting room. Such technology is commonly used today in many forms. Global positioning system ("GPS") devices and Global System for Mobile Communications ("GSM") devices provide the capability to show the location of the attached device relatively accurately on a real time basis. RFID tags can also be used for this purpose.

Figure 4:
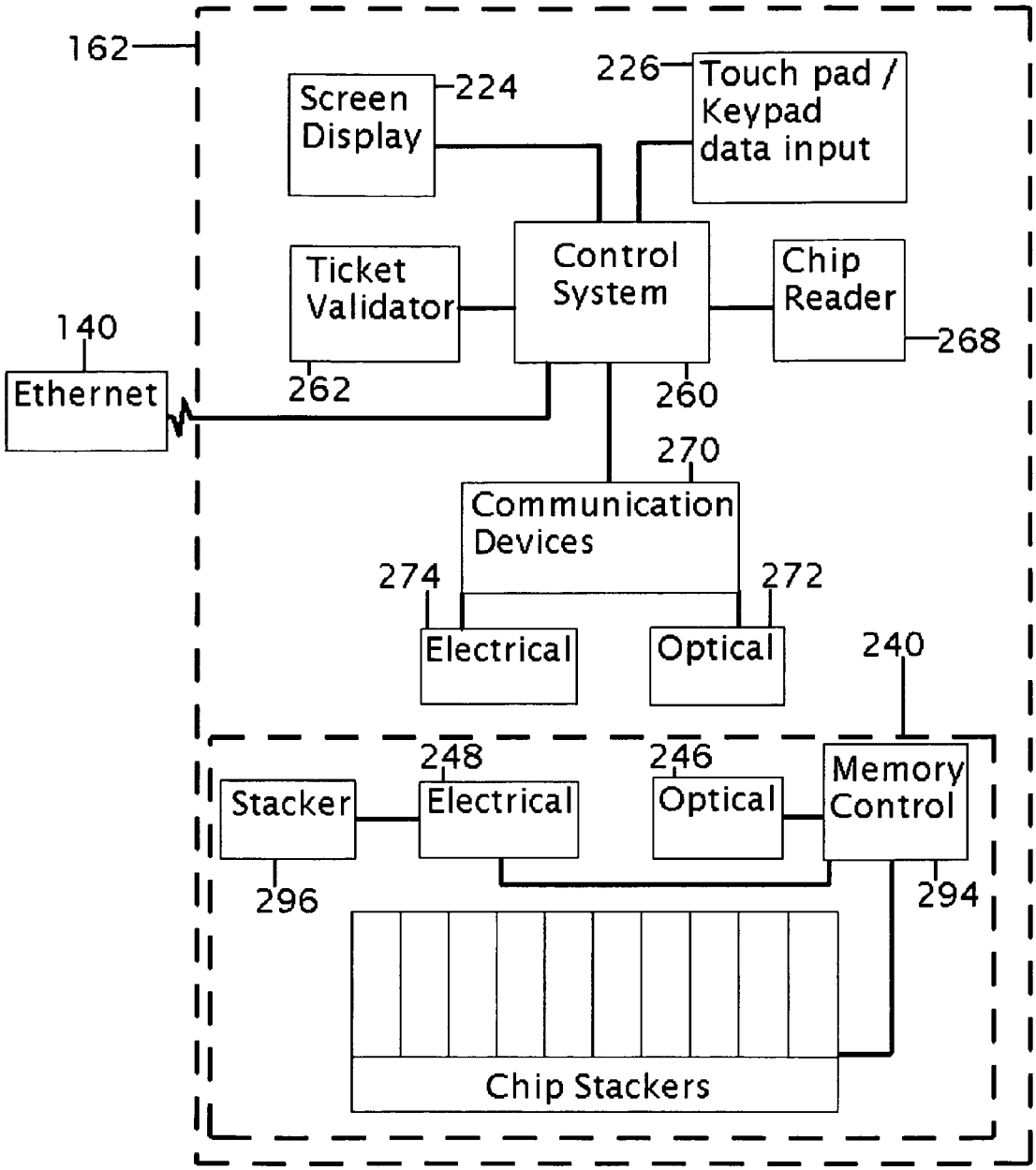
FIG. 4 is a block diagram of the major components of the kiosk of the present invention.

FIG. 4 depicts a block diagram of the major components of the chip dispensing kiosk 162 as well as the chip vault 240. The kiosk control assembly 220 houses a control system 260, which is the primary controller for the entire chip dispensing kiosk 162. The control system 260 is in operative communication with the Ethernet 140, as described with respect to FIG. 1, and there by with the various other casino computer terminals. Within the chip dispensing kiosk 162, the control system 260 interacts with a ticket/bill validator 262, which is positioned behind the ticket/bill acceptor slot 222. The ticket/bill validator 262 can be a standard note validator, which is available from JCM American of Las Vegas Nev., which is capable of reading a bar coded ticket as well as reading various currencies. For purposes of the chip dispensing kiosk 162, however, the primary aspect of the ticket/bill validator 262 will be to read bar code or otherwise encoded tickets having specific information and any instructions concerning the dispensing of casino chips. If a standard note validator is used here the control system 260 could obviously be programmed to dispense chips in return for cash inserted therein.

The control system 260 is also electrically interconnected to the screen display 224. The screen display 224 can be an LED type of display or a plasma display, which can provide or display information concerning the status of the chip dispensing kiosk 162, including the amount and number of casino chips, which are stored in the chip vault 240 at any given time, the amount of chips requested in a fill event ticket inserted into the ticket/bill validator 262, and the amount of chips deposited into the chip dispensing kiosk 162 via the chip deposit bezel and chip drop slot 214. The screen display 224 may also include a biometric security device such as a thumb print scanner or hand scanner that will allow added security to control access to the chips within the chip dispensing kiosk 162. Thus, for example, only the Pit Manager would be able to access the casino chips within chip dispensing kiosk 162 and authorize the chip dispensing kiosk 162 to dispense chips by a thumb or a hand scan on the biometric screen on the screen display 224.

The control system 260 is also electrically interconnected to the touch pad or key pad 226. The touch pad or key pad can be comprised of either a touch screen type input device where information is entered into the control system 260 by touching the appropriate locations of the screen, or a bank of standard numeric or alphanumeric keys, which may be used to enter data into the control system 260 to provide specific instructions for various events. For example, the touchpad or keypad could be utilized to identify a specific Pit Manager who will be authorized during the course of a shift to access the chip dispensing kiosk 162, to input specific information relative to chip requests or events for a specific table and/or entering other similar types of data.

The control system 260 is preferably also interconnected to a chip reader 268. The chip reader is positioned below the chip drop slot 214 to read chips that are inserted through the chip drop slot and passed to the chip vault 240 via drop slot 244 on the top of the chip vault 240. The chip reader 268 may be an optical reader or an RFID reader capable of reading, and characterizing information on chips as they pass thru the drop slot 214. RFID reading devices of the type that can read RFID embedded chips are known in the art as discussed within U.S. Pat. No. 5,735,742 to Chip Track International. Alternatively, the chip reader may be an optical reader or a combination of an optical and an RFID reader. The optical reader identifies certain encoded optical information on a surface of casino chips to provide an indication of the value and/or color of each casino chip as it passes through the drop slot 214.

The control system 260 is electrically interconnected to communication devices 270, which could include optical devices 272, or electrical devices 274 that can communicate across the space between the chip dispensing kiosk 162 and the removable chip vault 240. Within the chip vault 240, an optical receiver/emitter 246 and electrical contacts 248 are configured to be oppositely disposed with respect to the electrical devises 274 and optical devises 272 of the communications devices of the chip dispensing kiosk 162 when the chip vault 240 is properly in placed within the chip dispensing kiosk 162. Preferably, the chip vault 240 includes a memory and control component 294 that is communitively coupled to the electrical contact 248 and optical receiver/emitter 246, so that information concerning the amount of chips, for example, that are stored in the chip vault 240 may be communicated to the control system 260 as well as communicated to a count room, so as to download information as to either the number of chips remaining at the end of a shift that may be returned to the count room or the number of chips, which are stored within the chip vault 240 prior to its being delivered to the chip dispensing kiosk 162.

Preferably the chip dispensing kiosk 162 would have an uninterruptible power source (UPS) which provides protection from power spikes as well as providing battery backup in case of power failures. This will not only ensure preservation of data but also allow sufficient time to complete any data or chip processing that may be happening at the time of an eventual power outage.

The chip vault 240 may also include a ticket/bill stacker 296, which, if necessary, includes electrical power coupling to allow a power drive motor to drive belts to store tickets received by the ticket/bill validator of the chip dispensing kiosk 162 within the chip vault 240, so that when the chip vault 240 is taken from the chip dispensing kiosk 162 to the count room, the tickets identifying each dispensing of casino chips can be compared with the information in the memory and control component 294, concerning chips, which were deposited via the drop slot, and the amount of chips remaining in the chip vault 240, to properly account for the intake and dispensing of each chip to and from the chip vault 240.

In operation, the chip vault 240 is loaded with a certain number of chips within the count room and, once the chips are loaded, the chip vault is secured in a locked and closed position. The number of chips and each denomination of each chip is reported via the optical coupling 246 to the memory control component 294 of the chip vault 240. Thereafter, the chip vault 240 is delivered to the location of a chip dispensing kiosk 162. If a chip vault 240 is already in the chip dispensing kiosk 162, it is removed and a new fully stocked chip vault 240 is inserted. The chip vault 240 is secured in place and the door 202 is locked. Once the door is locked, the locking of the door is reported to the control system 260 of the chip dispensing kiosk 162. The control system 260 then communicates through the communication devices with the chip vault 240 to download the information from the memory as to the stocking of casino chips within the chip vault 240. The control system 260 then communicates the identification of the particular chip vault 240 as well as the amount of chips within the chip vault 240 to the casino database server 148. Once the casino database server 148 verifies with the count room that the correct number of chips and the particular chip vault 240 are correct, the control system 260 of the chip dispensing kiosk 162 is authorized to access chips in the chip vault 240. The control system 260 reports to the chip vault 240 that the identification of the chip vault 240 has been validated and then the chip vault 240 will be unlocked to allow dispensing of chips from the chip dispensing kiosk 162 and specifically the chip vault 240 therein.

When a gaming table requires a chip fill event, the gaming table prints out a chip fill ticket on its bill validator 20. Alternatively, the Pit Manager may print out a fill event ticket at the pit work station 146. The fill event ticket is then taken to the chip dispensing kiosk 162 and inserted into the ticket/bill acceptor slot 222 from which it is taken and scanned by the ticket/bill validator 262. The ticket/bill validator 262 identifies the total number of casino chips, which are being requested, the denominations of each of those chips and the number of each denomination and any other specific information concerning a dispense request, which is coded on to the fill event ticket. This information is communicated to the control system 260 of the chip dispensing kiosk 162. The control system 260 then communicates through the Ethernet 140 with the casino database server 148 to obtain validation of the ticket and the request for the dispensing of casino chips. Once the database server 148 validates the authenticity of the ticket, the control system 260 communicates with the chip vault 240 to dispense a specific number and denominations of chips. The chip vault 240 includes a dispense assembly, which will dispense the proper number of each denomination of casino chips to the chip dispense slot 242, and from there to the chip dispense tray 210 of the chip dispensing kiosk 162. The chip dispense ticket is then passed to the stacker within the chip vault 240 for stacking and storage. The memory and control component 294 is updated to identify the number of chips that were dispensed and the denomination of each chip dispensed. Confirmation of the dispensing of the chips is communicated back to the control system 260. Optionally the chip dispensing kiosk may include a ticket printer (not shown) but such as is often used in the gaming machines and table bill acceptors 20.

The Pit Manager or one of the other pit personnel such as the dealer can then take chips from the chip dispense tray 210 of the chip dispensing kiosk 162 to the specific gaming table requesting a fill event. Preferably, another fill event ticket corresponding to the ticket provided to the chip dispensing kiosk 162 can be printed and received either from the pit work station 146 or the chip dispensing kiosk 162 to be moved with the chips and inserted into the validator 20 at the gaming table and thereby the number of chips provided to the specific gaming table for a fill event is recorded and communicated back through the Ethernet to the database server 148. In this manner, the casino can track the dispensing of each chip from the chip dispensing kiosk 162 to the gaming tables 10 and confirm that the chips have been received at the specified gaming table. If a period of time in excess of the anticipated time necessary to take the chips from the chip dispensing kiosk 162 to a specific gaming table is exceeded, an alert system can be provided to advise the Pit Manager and/or security personnel.

It should be noted here that while the pit work station 146 and the chip dispensing kiosk 162 are shown and described as separate devices, it would be easy for one skilled in the art to integrate these two devices into the same or adjacent location or structure. In which case the description and functions of the work station and kiosk would remain the same but could be performed without having to provide duplicate component devices such as touch pads, validators, and printers.

The chip vault 240 may include a plurality of chip stackers into which columns or stacks of chips are deposited and maintained. The chip stackers can be configured to drop specific numbers of chips to the chip dispense tray as required. In addition, the vault 240 may include a chip distributor, which will distribute chips received at the top of the chip dispensing kiosk 162, to distribute them for stacking within the respective stacks of chips by specific denominations. The distributor is provided below the drop slot 244 and is configured so that it can direct each received chip to a proper location within the chip stackers.

The chip stackers of the chip vault 240 may also or alternatively be augmented by an opening for receiving an empty gaming table chip tray (not shown). The chip vault 240 may then deposit a pre-determined number of any given chip type or denomination into each chip tray channel as required for the gaming table to which it is to be delivered. The specific table tray ID can be programmed to activate the automatic loading of any pre-determined bank value and/or chip denomination configuration. The specifics of the pre-programmed chip denomination configuration would be determined based on a number of table game specifications such as but not limited to: the minimum bet denomination or bet unit, the maximum bet limit, the typical number of players accommodated, and the historical shift performance. The specific chip denomination configuration can be operator selectable or automatically selected based on the chip tray's table ID and other criterion such as period of operation. In all cases the device may communicate with the count room computer 166 to receive loading instructions and/or report the resulting count verification and loading information.

Figure 5:
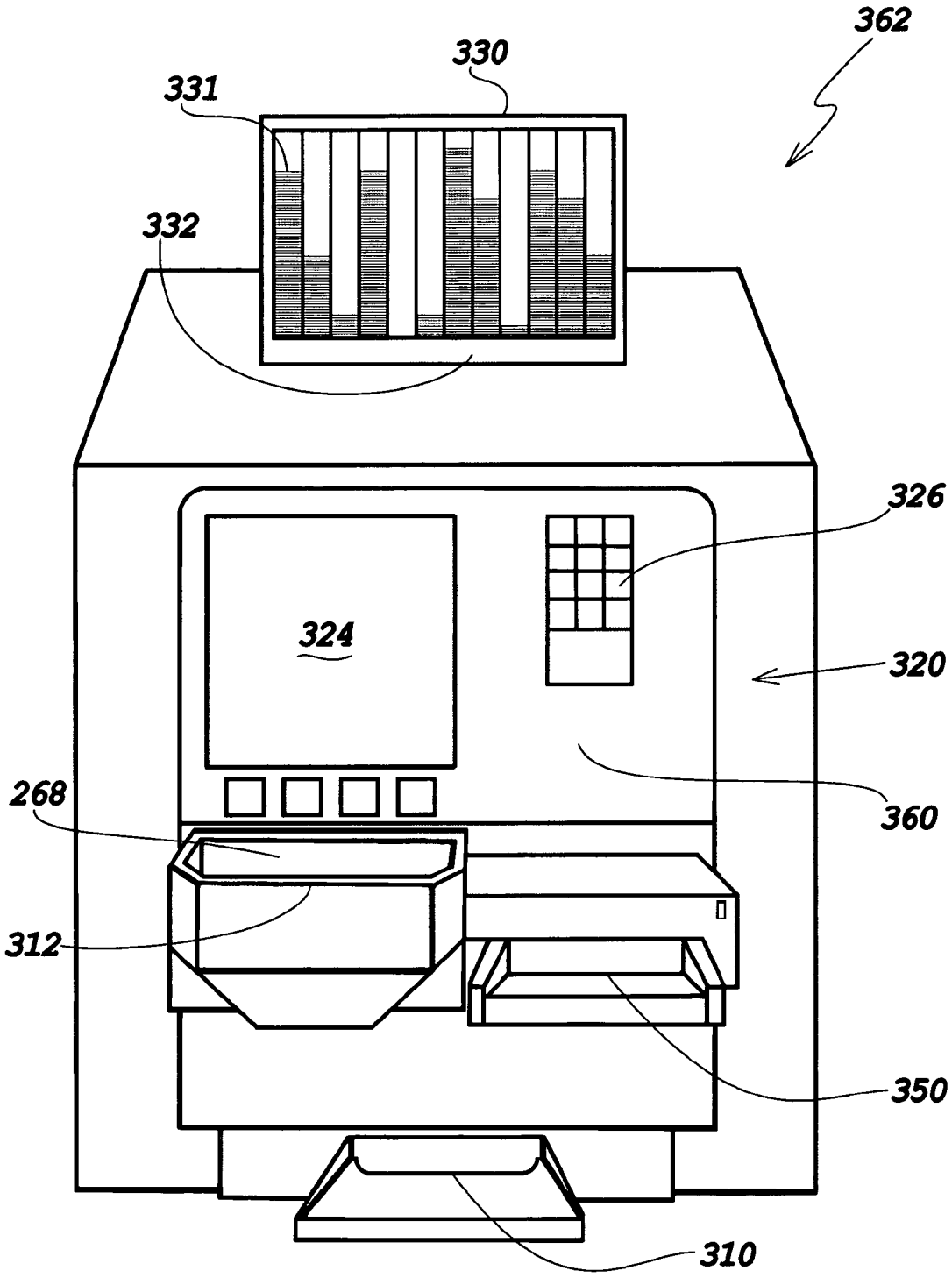
FIG. 5 is a view of a simplified casino chip tray loading device.

Another embodiment of the chip kiosk described above is a simpler device designed to mainly perform the function of counting dumped gaming chips for auditing purposes (verifying the physical presents of chips) and then loading chips into a table chip tray based on a specific bank value and/or chip denomination configuration. While this embodiment of a chip kiosk may have one or more of the features described in previous embodiments, it preferably is mainly configured with a chip drop/acceptance slot, means for electronically identifying chip denomination, means for separating or sorting chips into respective groups of chips of same denomination or type, control system 360 for performing calculations on chip denomination data and controlling the sorting and dispensing means of said chip tray loading device, and dispensing means for loading a removable gaming table chip tray to a selected chip tray bank value and chip denomination configuration. Such a chip tray loading device 362 could be either free standing or suitable for table top operation. FIG. 5 shows one such embodiment of the chip tray loading device 362.

The chip tray loading device 362 provides a chip deposit bezel 312 into which a contents of a table chip tray can be dumped in bulk for counting and sorting. Chips deposited into said chip deposit bezel 312 will then be directed to a means for electronically identifying and characterizing the chips into groups of similar denomination and/or color. Preferably this means for electronically identifying and characterizing the chips is comprised of a chip reader 268. Various means for identifying chip denominations and/or color such as the chip reader 268 have been discussed previously. Once the deposited chips have been electronically identified and characterized they may be conveyed to temporary group storage locations either internal to the device (not shown) or external to the chip tray loading device 362 such as in the chip stack organizer 330. As the dumped chips are characterized the resulting value/denomination information is communicated to the control system 360 for processing and communication to other management system components/processors. Such information as chip quantities and total tray bank value is then available for various calculation/auditing purposes.

In the possible situation where the desired chip denomination configuration has already been determined and the empty target table chip tray (not shown) has been inserted into the table chip tray loader 350, the characterized chips may be directly conveyed to and loaded into said target tray according to said desired chip denomination configuration. If either of these conditions does not exist when the first of the dumped chips have been characterized and ready for disposition they would then be conveyed to a temporary group storage location until needed for redistribution. As another possible mode of operation the chip tray loading device 362 may be directed to pause the processing of dumped chips until both the desired chip denomination configuration has been determined and the empty table chip tray has been inserted into the table chip tray loader 350 and then to proceed with loading a standard table chip tray.

As an example, this then allows a user to select a function such as "count and reload" or "refresh" and then dump the chips from a table chip tray into the chip deposit bezel 312 of the chip tray loading device 362 and place the tray into the table chip tray loader 350 for automatic reloading. If "count and reload" were selected the chip tray loading device 362 would physically count the chips and sum the denomination/values for the control system 360 and then reload the table chip tray with the same number of each type chip and same total tray bank value. This function may be used for auditing purposes. However, if "refresh" were selected the chip tray loading device 362 would physically count the chips and sum the values for the control system 360 and then automatically reload the table chip tray with the standard chip denomination configuration which has been assigned to table chip trays for that given table's ID. This function may be useful for reinitializing the table's chip tray bank between shifts or for a change of dealers. In all cases the count information and table tray ID is available in the control system 360 for communication to other system processors for reporting, verification or auditing purposes.

As described in the above discussion a valuable inventive feature of both the previously described chip dispensing kiosk 162 and the chip tray loading device 362 is the automatic loading of a standard table chip tray when inserted into the device's table chip tray loader 350. This table chip tray loader 350 is shown in FIG. 5 on the front of the chip tray loading device 362 but obviously may be placed on any side or orientation to the front loading control assembly 320. The table chip tray loader 350 is large enough to accept a wide variety of different size table chip trays both of the ICT Intelligent Chip Tray module type as well as other older "dumb" table chip trays. The Intelligent Chip Tray module type trays carry an imbedded memory or module that contains various information about host ICT such as but not limited to ID, total bank value, numbers and values of chips held, and etc. As discussed previously, there are various ways for electronic sensing of chip values that can be incorporated into the table tray itself to acquire and maintain such information such that it can be wirelessly communicated to other devices. If for instance such information stored in the ICT module can be transmitted by way of radio or IR waves to an appropriate receiver.

The chip tray loading device allows selection of tray type as well as chip denomination configuration which controls the number and type of chips to be loaded in each channel of the table chip tray. The selection process may be pre-programmed into the chip tray loading device 362, or communicated from a remote controlling processor, or sensed by the device from the ICT type table chip tray module from such information as table tray ID or other casino standard table type configurations. After the loading operation is complete the table chip tray can be removed and carried to the specified gaming table to start play or replace the existing table chip tray for transport back to the chip tray loading device 362 for counting or re-initialization.

The chip tray loading device 362 may have other means of chip distribution as shown in FIG. 5. A chip stack organizer 330 is comprised of multiple individual chip columns 331 each receiving chips of one denomination and/or color. As mentioned previously these individual chip columns 331 may be used as temporary group storage locations for similar chips. They also may be used to allow distribution of stacks of chips of either standard quantities or any other number required. Depending on the intended location of the chip tray loading device 362 this chip stack organizer 330 may optionally have a security cover preferably transparent such that the quantities available are readily visible. In any case the individual chip columns 331 would preferably include an electronic presence detector 332 for continuously monitoring the number of chips and value of such chips which in concert with the control system 360 may instantly confirm the amounts removed and the authorization of such manual stack removals. The technology used for such an electronic presence detector 332 is known in the art and may be similar to that used in the before mentioned chip reader 268 or other known less expensive techniques such as electronic light or induction sensors.

As a further optional form of chip distribution the chip tray loading device 362 may load stacks of chips into a bulk chip tray carrier. Such chip tray carriers are typically used to carry and store bulk quantities of sorted gaming chips. It is comprehended that one or more standard bulk chip tray carriers may be placed into the bulk chip tray carrier loader 310 of the chip tray loading device 362 for automatic loading.

The control system 360 of the chip tray loading device 362 would typically be located internal to the device, behind and in communicative cooperation with the loading control assembly 320. The control system 360 may perform many of the same functions as the chip kiosk control system 260 that has been previously explained and shown in FIG. 4, and depending on which similar features are incorporated into the chip tray loading device 362. The control system 360 may be in advantageously connected through various communication devices to other casino computer terminals and can receive information from ICT modules. As described earlier the control system 360 is in operative communication with all sensors such as the chip reader 268 and electronic presence detector 332. It then controls all conveyance mechanisms in the chip tray loading device 362 to govern the movement of chips to the various temporary group storage locations and distribution features. Obviously the control system 360 is electronically connected to any input and display devices such as the screen display 324 and the touch pad or key pad 326.

The touch pad or key pad can be comprised of either a touch screen type input device where information is entered into the control system 360 by touching the appropriate locations of the screen, or a bank of standard numeric or alphanumeric keys, which may be used to enter data into the control system 360 to provide specific instructions for various loading requests. For example, the touchpad or keypad could be utilized to identify a specific Pit Manager or cashier who will be authorized during the course of a shift to access the chip tray loading device 362, to input specific information relative to chip requests or reloading table chip trays for a specific table. Depending again on the location of the chip tray loading device 362, these input devices or screens may necessarily include various means for accepting security codes or even biometric thumb, hand, or eye scanning to ensure high security for these valuable casino chips.

In view of the foregoing discussion, it may be readily understood that alternative embodiments are contemplated. Having thus described different embodiments of the invention, other variations and embodiments that do not depart from the spirit of the invention will become readily apparent to those skilled in the art. The scope of the present invention is thus not limited to any one particular embodiment, but is instead set forth in the appended claims and the legal equivalents thereof.

What is claimed is:

1. A chip tray loading device for automated loading of casino table chip trays, the device comprising:

a means for accepting chips in bulk;

a chip reader for electronically identifying and characterizing each chip;

a table chip tray loader for automatically loading chips into a table chip tray based on a selected chip denomination configuration;

a means for conveying chips from said means for accepting chips to said table chip tray loader; and a control system coupled to said means for identifying and characterizing each chip and said table chip tray loader to control the automatic loading of said table chip tray, when said table chip tray is removed from a casino table and placed in said chip tray loading device, according to said selected chip denomination configuration.

2. The chip tray loading device of claim 1, wherein said control system can perform calculations on chip characteristic information.

3. The chip tray loading device of claim 1, wherein said control system includes means for communicating with a plurality of computers positioned throughout the casino including at least one of:

a pit workstation computer;

a cashier station computer;

a count room computer;

an intelligent chip tray module;

a database server; and a Host Management System.

4. The chip tray loading device of claim 3, further comprising:

a data input device for allowing an operator to provide instructions for selecting said selected chip denomination configuration to automatically load said table chip tray.

5. The chip tray loading device of claim 3, further comprising:

a data input device for allowing an operator to provide instructions for automatically loading said table chip tray to a pre-programmed chip denomination configuration.

6. The chip tray loading device of claim 3, further comprising:

a data input device for allowing an operator to provide instructions for selecting said selected chip denomination configuration to automatically load said table chip tray, wherein said chip denomination configuration is sensed from a module on said table chip tray.

7. The chip tray loading device of claim 1, further comprising:

one or more additional means of chip distribution selected from the group of:

a chip stack organizer; and a bulk chip tray carrier loader.

8. The chip tray loading device of claim 7, wherein said chip stack organizer further comprises an electronic presence detector.

9. The chip tray loading device of claim 7, wherein said chip stack organizer also provides temporary group storage locations from which chips may be subsequently conveyed to the table chip tray loader.

10. A chip tray loading device for dispensing casino chips, comprising:

a chip vault for dispensing casino chips;

an input device for entering data into said device;

a table chip tray loader for automatic loading of table chip trays;

a controller interfacing with said input device, table chip tray loader, and chip vault for controlling the dispensing of casino chips upon receipt of instructions and authorization information.

11. The chip tray loading device of claim 10, further comprising:

a chip reader for automatically sensing and tabulating chip denominations and quantities.

12. The chip tray loading device of claim 10, further comprising:

a biometric security device for accepting biometric information to authorize transactions performed by said casino chip tray loading device.

13. The chip tray loading device of claim 10, wherein said chip tray loading device is located in the pit workstation.

14. The chip tray loading device of claim 10, wherein said casino chip tray loading device is located in or approximate to the casino's table game pit area.

15. A method of casino table chip tray management for the automation and validation of table chip tray loading for gaming tables with one or more chip tray loading devices, the steps comprised of:

accepting chips dumped from a table chip tray in bulk;

identifying and characterizing each chip;

conveying chips to an automatic table chip tray loader;

loading chips into a table chip tray according to a defined chip tray denomination configuration when said table chips trays are removed from a casino table and placed in said one or more chip tray loading devices.

16. The method of claim 15 wherein the step of identifying and characterizing each chip further includes the step of processing the values of the chips dumped from said table chip tray in bulk.

17. The method of claim 16 further including the step of communicating the values of the chips to another casino computer.

* * * * *